US008998576B2

(12) United States Patent
Miller et al.

(10) Patent No.: US 8,998,576 B2
(45) Date of Patent: Apr. 7, 2015

(54) PUMP WITH HYDRAULIC ISOLATOR

(75) Inventors: James Miller, Sanford, NC (US); Leonard Richiuso, Raleigh, NC (US); Rick Langlois, Sunnyvale, CA (US)

(73) Assignee: Pentair Water Pool and Spa, Inc., Sanford, NC (US)

( * ) Notice: Subject to any disclaimer, the term of this patent is extended or adjusted under 35 U.S.C. 154(b) by 744 days.

(21) Appl. No.: 13/288,753

(22) Filed: Nov. 3, 2011

(65) Prior Publication Data

US 2013/0115071 A1 May 9, 2013

(51) Int. Cl.
*F04D 29/42* (2006.01)
*F04D 29/44* (2006.01)

(52) U.S. Cl.
CPC ..... *F04D 29/428* (2013.01); *F04D 29/445* (2013.01)

(58) Field of Classification Search
CPC ..... F04D 17/08; F04D 29/42; F04D 29/426; F04D 29/428; F04D 29/4286; F04D 29/44; F04D 29/445
USPC ..... 415/196, 197, 182.1, 203, 204, 206, 415/207, 208.1, 211.2, 224, 224.5
See application file for complete search history.

(56) References Cited

U.S. PATENT DOCUMENTS

| | | | | |
|---|---|---|---|---|
| 721,207 | A | | 2/1903 | Lockwood |
| 797,058 | A | | 8/1905 | Hedlund |
| 1,254,156 | A | | 1/1918 | Parsons |
| 1,925,898 | A | | 9/1933 | Fritz |
| 1,952,179 | A | | 3/1934 | Milkowski et al. |
| 2,121,068 | A | | 6/1938 | Buechler |
| 2,163,464 | A | | 6/1939 | Llewellyn |
| 2,255,239 | A | | 9/1941 | Allen |
| 3,155,045 | A | | 11/1964 | Lown et al. |
| 3,292,733 | A | | 12/1966 | Everett et al. |
| 3,316,848 | A | | 5/1967 | Egger |
| 3,503,465 | A | | 3/1970 | Kobayashi et al. |
| 3,552,888 | A | * | 1/1971 | Ericksson ..... 417/423.11 |
| 3,918,829 | A | | 11/1975 | Korzec |
| 4,052,133 | A | | 10/1977 | Yeater |
| 4,129,402 | A | | 12/1978 | Eberhardt |
| 4,202,654 | A | * | 5/1980 | Marlow ..... 415/113 |
| 4,264,273 | A | | 4/1981 | Grzina |
| 4,371,310 | A | | 2/1983 | Henry, IV et al. |
| 4,917,571 | A | | 4/1990 | Hyll et al. |
| 4,974,998 | A | | 12/1990 | Heineman |
| 5,103,929 | A | | 4/1992 | Wheeler et al. |
| 5,127,800 | A | | 7/1992 | Hyll et al. |
| 7,416,383 | B2 | | 8/2008 | Burgess |
| 7,780,406 | B2 | | 8/2010 | Sloan et al. |
| 7,806,654 | B2 | | 10/2010 | Burgess |

FOREIGN PATENT DOCUMENTS

| | | | |
|---|---|---|---|
| CH | 296435 A | * | 2/1954 |
| CN | 200968074 | | 10/2007 |
| GB | 1189469 A | * | 12/1967 |
| JP | 8049692 | | 2/1996 |
| SU | 1027431 | | 7/1983 |
| SU | 1671979 | | 8/1991 |

* cited by examiner

*Primary Examiner* — Edward Look
*Assistant Examiner* — Jesse Prager
(74) *Attorney, Agent, or Firm* — Quarles & Brady LLP

(57) ABSTRACT

Embodiments of the invention provide a hydraulic isolator to split a volute of a pump into two compartments. The hydraulic isolator is positioned within the volute and includes an inlet positioned around a volute inlet channel of the pump, and an outlet positioned adjacent to an outlet channel of the pump. The hydraulic isolator also includes a toroidal portion to at least partially surround an impeller of the pump.

14 Claims, 5 Drawing Sheets

PUMP WITH HYDRAULIC ISOLATOR

BACKGROUND

Plastic pump volutes undergo large amounts of stress when pressurized. A pump volute is designed so that it can support the pressure without bursting or permanently deforming. In plastic pump part design, common solutions include adding ribs or thicker walls. However, the addition of these structural members compromises the hydraulic space within the pump volute (e.g., by shrinking the space or by creating an uneven or rough flow path). Some methods to create a smooth internal volute chamber while still providing structural support result in a less desirable external appearance due to requirements for similar wall thicknesses throughout the plastic parts.

SUMMARY

Some embodiments of the invention provide a pump including a pump housing, a motor, a seal plate, and a hydraulic isolator. The pump housing includes a volute and internal ribs extending into the volute. The motor is coupled to the pump housing and the seal plate encloses an impeller within the volute. The hydraulic isolator is positioned within the volute and coupled to the pump housing. The hydraulic isolator substantially splits the volute into a first compartment where fluid is pumped by the impeller and a second compartment where the internal ribs are positioned.

Some embodiments of the invention provide a hydraulic isolator to split a volute of a pump into two compartments. The hydraulic isolator includes snap fit features that engage an inner wall of the pump to position the hydraulic isolator within the volute, an inlet capable of being positioned around a volute inlet channel of the pump, and an outlet capable of being positioned adjacent to an outlet channel of the pump. The hydraulic isolator also includes a toroidal portion to at least partially surround an impeller of the pump.

DETAILED DESCRIPTION

Figure 1A:
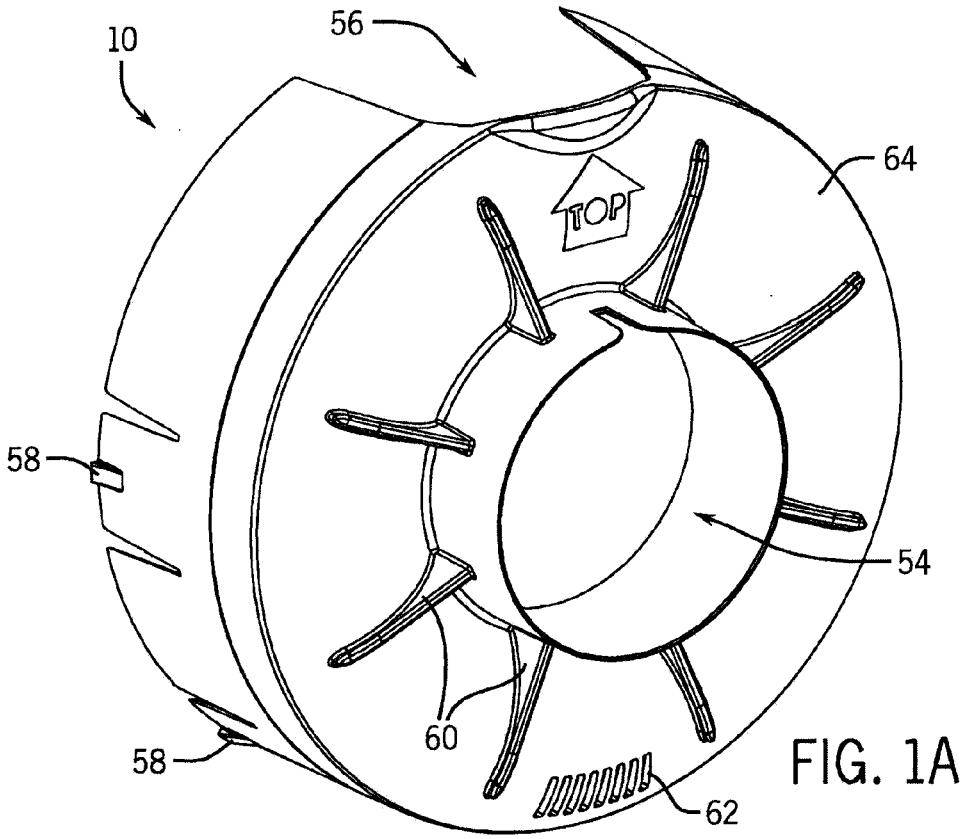
FIG. 1A is a front perspective view of a hydraulic isolator according to one embodiment of the invention.
Figure 1B:
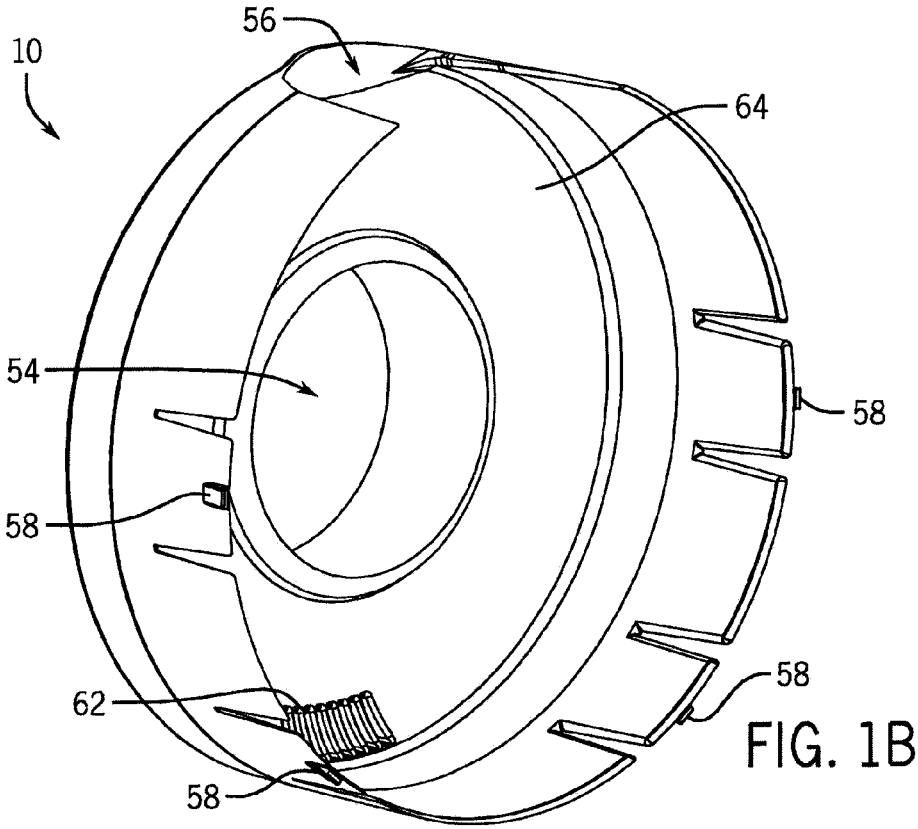
FIG. 1B is a rear perspective view of the hydraulic isolator of FIG. 1A.
Figure 1C:
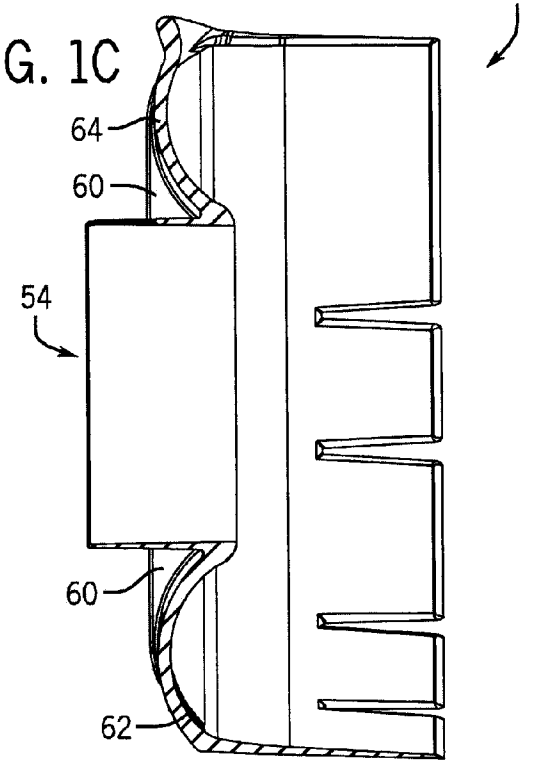
FIG. 1C is a side view of the hydraulic isolator of FIG. 1A.
Figure 1D:
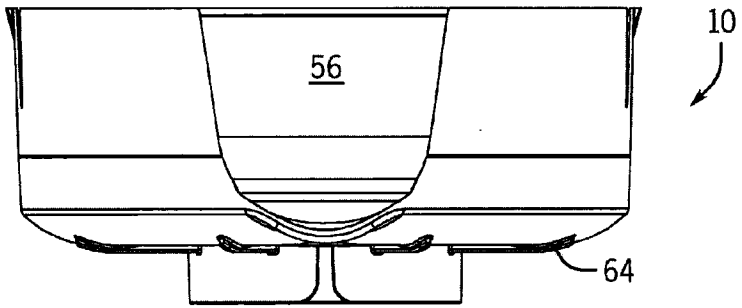
FIG. 1D is a top view of the hydraulic isolator of FIG. 1A.
Figure 1E:
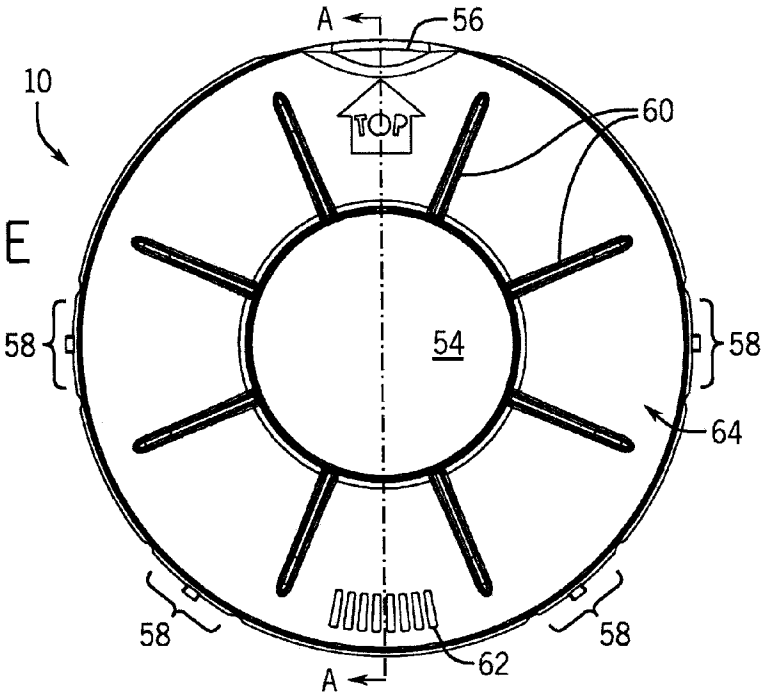
FIG. 1E is a front view of the hydraulic isolator of FIG. 1A.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

The following discussion is presented to enable a person skilled in the art to make and use embodiments of the invention. Various modifications to the illustrated embodiments will be readily apparent to those skilled in the art, and the generic principles herein can be applied to other embodiments and applications without departing from embodiments of the invention. Thus, embodiments of the invention are not intended to be limited to embodiments shown, but are to be accorded the widest scope consistent with the principles and features disclosed herein. The following detailed description is to be read with reference to the figures, in which like elements in different figures have like reference numerals. The figures, which are not necessarily to scale, depict selected embodiments and are not intended to limit the scope of embodiments of the invention. Skilled artisans will recognize the examples provided herein have many useful alternatives and fall within the scope of embodiments of the invention.

FIGS. 1A-1E illustrate a hydraulic isolator 10 according to one embodiment of the invention. The hydraulic isolator 10 can be used in pumps, valves, and/or filter elements to provide an optimal combination of structural support and fluid transfer efficiency through such elements.

Figure 2:
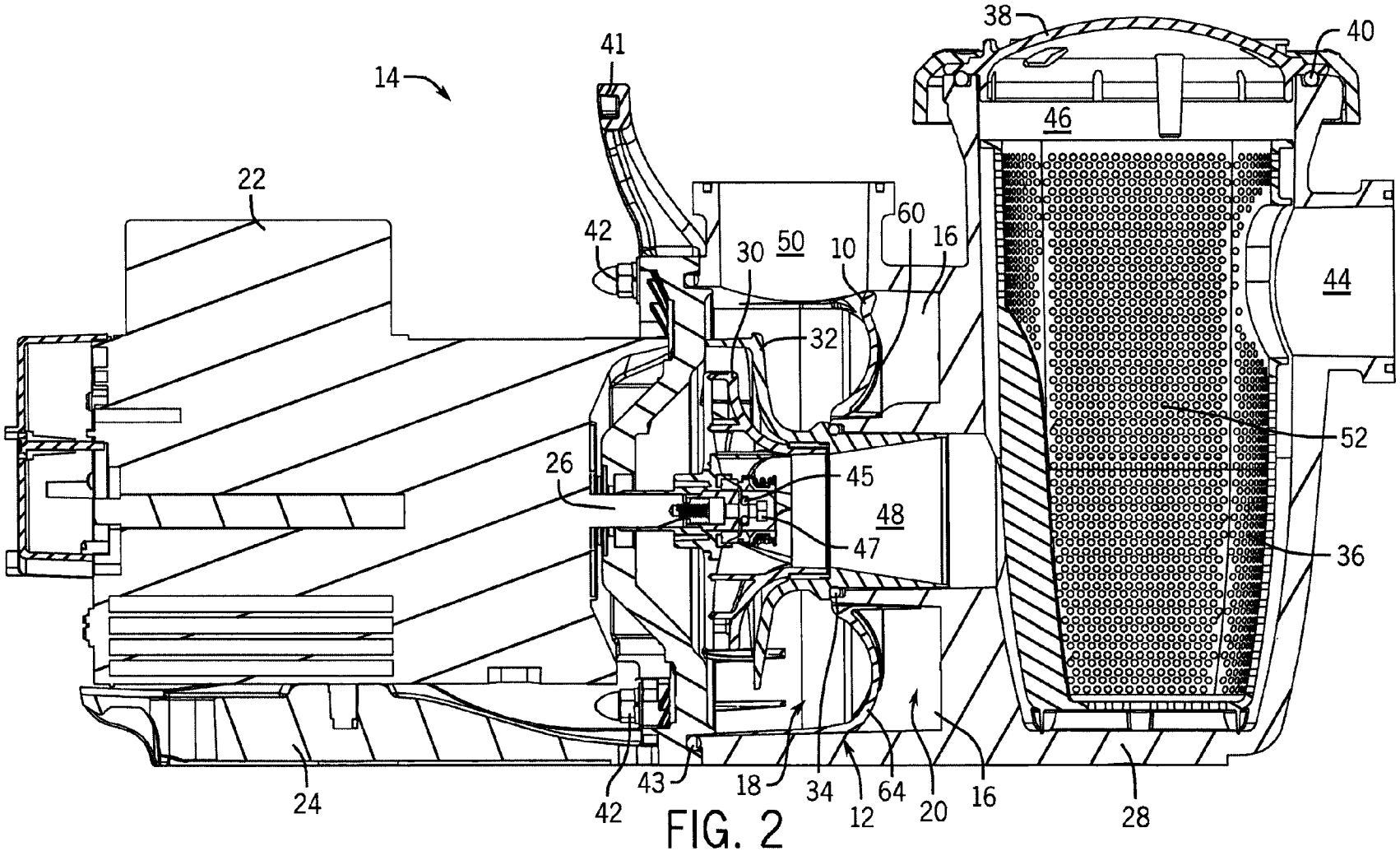
FIG. 2 is a cross-sectional view of a pump with a hydraulic isolator according to one embodiment of the invention.

In one embodiment, as shown in FIG. 2, the hydraulic isolator 10 can be positioned within a volute 12 of a pool pump 14 that includes internal ribs 16 extending into the volute 12. As shown in FIG. 2, the hydraulic isolator 10 can separate the volute 12 into two separate compartments, such as a hydraulic space 18 where fluid is pumped and a structural support area 20 to accommodate the internal ribs 16. This can allow the volute 12 to have an internal design focused on strength while keeping the hydraulic space 18 isolated from the internal ribs 16. More specifically, this can allow sufficient structural support to protect the volute 12 from bursting or deforming under high pressures while also providing higher pumping efficiency and smoother, quieter operation and priming due to the smooth fluid path (i.e., the hydraulic space 18) for pumping the fluid.

Figure 3A:
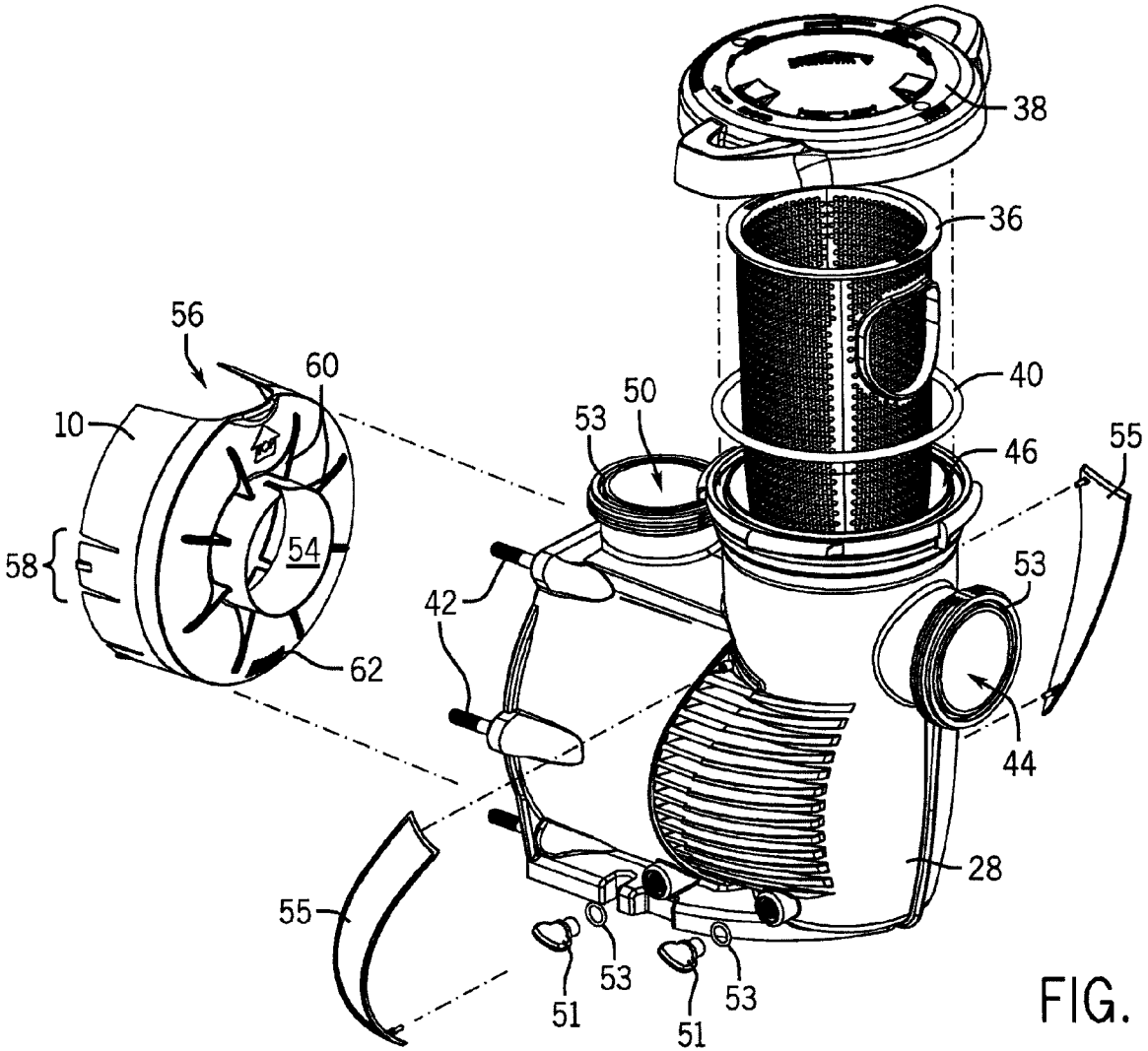
FIG. 3A is a partial perspective view of the pump and hydraulic isolator of FIG. 2.
Figure 3B:
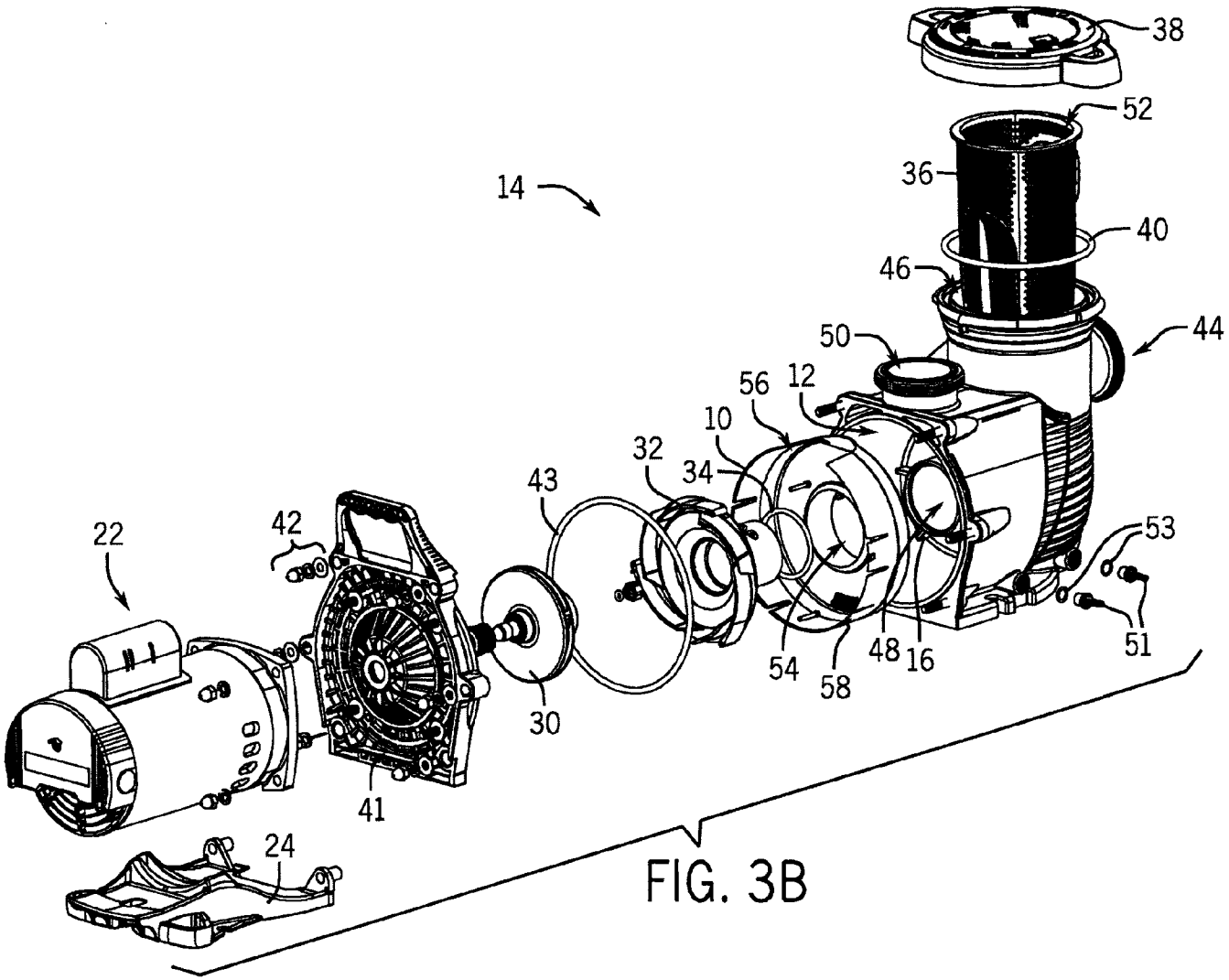
FIG. 3B is another perspective view of the pump and hydraulic isolator of FIG. 2.

As shown in FIGS. 2, 3A, and 3B, the pump 14 can include a motor 22, a motor base 24, and a rotatable motor shaft 26. The pump 14 can also include a pump housing 28 with an impeller 30 positioned within the volute 12, a diffuser 32 adjacent to the impeller 30, a diffuser o-ring 34, a filter basket 36, a housing cover 38, and a cover o-ring 40. The motor 22 can be coupled to the pump housing 28 by a seal plate 41, fasteners 42, and an o-ring 43 to enclose the impeller 30 and the diffuser 32 within the volute 12. The impeller 30 can be coupled to the motor shaft 26 via one or more seals 45 and bushings 47, as shown in FIG. 3B. In addition, the pump 14 can include an inlet channel 44, a top opening 46, a volute inlet channel 48, and an outlet channel 50. The volute 12 can separate the volute inlet channel 48 and the outlet channel 50. A filter cavity 52 can separate the inlet channel 44, the top opening 46, and the volute inlet channel 48, and can house the filter basket 36. As shown in FIGS. 3A and 3B, the pump 14 can also include drain plugs 51, o-rings 53 positioned adjacent to the drain plugs 51, the inlet channel 44, and the outlet channel 50, and one or more accent pieces 55.

As described above, the hydraulic isolator 10 can be positioned within the volute 12 of the pump 14. The hydraulic isolator 10 can include an inlet 54 and an outlet 56 (as shown in FIGS. 1A-1D), which can be positioned in line with the volute inlet channel 48 and the outlet channel 50, respectively, as shown in FIG. 2. For example, the inlet 54 can substantially surround the volute inlet channel 48 for proper positioning of the hydraulic isolator 10 within the volute 12. The outlet 56 can be positioned adjacent to the outlet channel 50. As a result, the inlet 54 and the outlet 56 can be positioned substantially perpendicular from each other.

In some embodiments, the hydraulic isolator 10 can include snap fit features 58 that engage the pump housing 28 and/or the motor housing 22. The snap fit features 58 can be designed so that the hydraulic isolator 10 can be permanently installed within the volute 12. For example, prior to the pump housing 28 and the motor housing 22 being coupled together, the hydraulic isolator 10 can be pushed into the volute 12 until the snap fit features 58 snap into place within the pump housing 28 (e.g., on an inner wall of the pump housing 28). In other embodiments, the snap fit features 58 can be designed for temporary installation within the volute 12. In yet other embodiments, the hydraulic isolator 10 can be coupled to the pump housing 28 and/or the seal plate 41 by twist locks, threads, or other hardware.

The hydraulic isolator 10 can also include external ribs 60, which extend into the structural support area 20, for additional structural support. In addition, in some embodiments, the hydraulic isolator 10 can include priming holes 62 to assist in pump priming (e.g., by allowing a portion of fluid to flow and settle into the structural support area 20). The priming holes 62 can extend through a side of the hydraulic isolator 10 near its bottom end (e.g., substantially opposite from the outlet 56 at its top end).

In some embodiments, at least a portion 64 of the hydraulic isolator 10 can be substantially toroidal in shape. More specifically, the toroidal portion 64 can at least partially surround the impeller 30. One definition of a "toroid" is a surface generated by rotating a closed plane curve about a coplanar line that does not intersect the curve. A "torus" can be defined as a doughnut shaped surface generated by the revolution of a conic, especially a circle, about an exterior line lying in its plane. This toroidal shape can provide a substantially smooth flow path within the hydraulic space 18 of the volute 12. For example, during operation, fluid can enter the inlet channel 44, flow through the filter basket 36 and then into the volute inlet channel 48. The fluid can be pumped into the volute 12 by the rotating impeller 30, and the diffuser 32 can assist in directing the flow of the fluid as it exits the impeller 30 and enters the hydraulic space 18. The fluid continues to flow through the hydraulic space 18 until it exits the pump housing 28 through the outlet channel 50. A substantial amount of energy can be wasted in conventional pumps with internal ribs due to the rough or jagged flow path the fluid encounters as it travels through the volute across the internal ribs. As a result of the smooth fluid path created by the hydraulic isolator 10, less energy can be wasted as fluid travels through the hydraulic space 18, thus increasing pump performance and efficiency.

As described above, the hydraulic isolator 10 can be used to separate the hydraulic space 18 (e.g., a pump performance chamber) from the internal ribs 16 (e.g., structurally necessary parts of the pump). This differs from conventional cast iron pump volute liners which merely line the inside of the volute. These conventional liners are not meant to stand alone under high fluid pressure, but merely conform to the inside of the cast iron pump casing to protect the pump from abrasion. In contrast, the hydraulic isolator 10 of some embodiments of the invention can stand independently within the volute 12 to separate the two compartments 18, 20. More specifically, the toroidal portion 64 can be positioned substantially away from the inner walls of the pump housing 28, rather than against the walls like a conventional pump liner. Further, the hydraulic isolator 10 can withstand high fluid pressures by transferring such pressure to the pump housing 28 at the connection points where the hydraulic isolator 10 is coupled to the pump housing 28 (e.g., at least along the snap fit features 58).

It will be appreciated by those skilled in the art that while the invention has been described above in connection with particular embodiments and examples, the invention is not necessarily so limited, and that numerous other embodiments, examples, uses, modifications and departures from the embodiments, examples and uses are intended to be encompassed by the claims attached hereto. The entire disclosure of each patent and publication cited herein is incorporated by reference, as if each such patent or publication were individually incorporated by reference herein. Various features and advantages of the invention are set forth in the following claims.

The invention claimed is:

1. A pump comprising:

a pump housing including a volute and internal ribs extending into the volute;

a diffuser positioned within the volute;

an impeller positioned within the volute;

a motor coupled to the pump housing;

a seal plate enclosing the impeller within the volute; and a hydraulic isolator including an inlet projection portion and a cylindrical body portion, the hydraulic isolator positioned within the volute and coupled to the pump housing, the hydraulic isolator substantially splitting the volute into a first compartment where fluid is pumped by the impeller and a second compartment where the internal ribs are positioned, wherein the impeller is positioned within the diffuser and the diffuser is positioned within the cylindrical body portion of the hydraulic isolator.

2. The pump of claim 1, wherein the cylindrical body portion of the hydraulic isolator is coupled to the pump housing by snap fit features.

3. The pump of claim 1, wherein the hydraulic isolator includes priming holes to allow a portion of fluid from the first compartment to flow into the second compartment.

4. The pump of claim 1, wherein the hydraulic isolator includes a toroidal portion that couples the inlet projection portion to the cylindrical body portion.

5. The pump of claim 1, wherein a sidewall of the cylindrical body portion of the hydraulic isolator defines an outlet aperture.

6. The pump of claim 1, wherein the pump housing includes an inlet channel, a volute inlet channel, and a filter cavity separating the inlet channel and the volute inlet channel.

7. The pump of claim 4, wherein the hydraulic isolator includes ribs that extend radially from an outer surface of the inlet projection portion and are coupled to a curved front surface of the toroidal portion and extend into the second compartment when the hydraulic isolator is positioned within the volute.

8. A hydraulic isolator to split a volute of a pump into two compartments, the hydraulic isolator comprising:

a cylindrical body portion including a plurality of snap fit features that engage an inner wall of the pump volute to position the hydraulic isolator within the volute;

an inlet projection portion positioned around a volute inlet channel of the pump;

an outlet located on the cylindrical body portion and capable of being positioned adjacent to an outlet channel of the pump; and a toroidal portion that couples the inlet projection portion to the cylindrical body portion, wherein the toroidal portion forms a front wall of the hydraulic isolator and separates the volute of the pump into a first compartment defined by the cylindrical body portion and the toroidal portion, and a second compartment defined by the toroidal portion, the inlet projection portion of the hydraulic isolator, and the inner wall of the volute.

9. The hydraulic isolator of claim 8 and further comprising priming holes extending through the toroidal portion.

10. The hydraulic isolator of claim 9, wherein the outlet is positioned adjacent to a first end of the pump housing and the priming holes are positioned adjacent to a second, opposite end of the pump housing.

11. The hydraulic isolator of claim 8, wherein the inlet projection portion and the outlet are oriented substantially perpendicular from each other.

12. The hydraulic isolator of claim 8, and further comprising ribs that extend radially from an outer surface of the inlet projection portion and are coupled to a curved front surface of the toroidal portion.

13. The hydraulic isolator of claim 12, wherein a side of the toroidal portion facing the first compartment is substantially smooth.

14. The hydraulic isolator of claim 13, wherein the curved front surface of the toroidal portion is positioned away from inner walls of the pump.

* * * * *